US009476253B2

(12) United States Patent
Lai

(10) Patent No.: US 9,476,253 B2
(45) Date of Patent: Oct. 25, 2016

(54) AUTOMATIC CORD COLLECTOR OF A WINDOW BLIND

(71) Applicant: Yung-Ching Lai, Singang Township (TW)

(72) Inventor: Yung-Ching Lai, Singang Township (TW)

( * ) Notice: Subject to any disclaimer, the term of this patent is extended or adjusted under 35 U.S.C. 154(b) by 388 days.

(21) Appl. No.: 14/254,320

(22) Filed: Apr. 16, 2014

(65) Prior Publication Data

US 2015/0300082 A1 Oct. 22, 2015

(51) Int. Cl.
*B65H 75/48* (2006.01)
*E06B 9/322* (2006.01)
*E06B 9/326* (2006.01)

(52) U.S. Cl.
CPC ..... *E06B 9/322* (2013.01); *E06B 9/326* (2013.01)

(58) Field of Classification Search
CPC ..... B65H 75/48; B65H 75/4431; E06B 9/26; E06B 9/28; E06B 9/30; E06B 9/322; E06B 9/326; E06B 9/262; E06B 9/56; E06B 9/303; E06B 2009/2622; E06B 2009/2625; E06B 2009/3265
See application file for complete search history.

(56) References Cited

U.S. PATENT DOCUMENTS 4,271,893 A * 6/1981 McCluskey ..... E06B 9/326 160/178.1 R
5,274,357 A * 12/1993 Riordan ..... G08B 13/126 160/10
5,279,473 A * 1/1994 Rozon ..... B65H 75/28 160/178.1 R
5,918,658 A * 7/1999 Schartner ..... E06B 9/30 160/173 R
6,463,986 B1 * 10/2002 Gouda ..... E06B 9/326 160/178.1 R
6,681,831 B1 * 1/2004 Cheng ..... E06B 9/262 160/170
6,745,969 B1 * 6/2004 Gouda ..... E06B 9/326 160/178.1 R
7,156,338 B2 * 1/2007 Schartner ..... E06B 9/326 160/178.1 R
8,366,033 B2 * 2/2013 Chang ..... B65H 75/48 160/178.1 R
2002/0144792 A1 * 10/2002 Gouda ..... E06B 9/326 160/178.1 R
2010/0181409 A1 * 7/2010 Chen ..... B65H 75/4431 242/376
2016/0090778 A1 * 3/2016 DeWard ..... E06B 9/326 160/321

* cited by examiner

*Primary Examiner* — William A Rivera
(74) *Attorney, Agent, or Firm* — The Weintraub Group, P.L.C.

(57) ABSTRACT

An automatic cord collector of a window blind has a housing, a holding assembly mounted inside the housing with one end of each pull cord fastened therein, an adjusting assembly mounted inside the housing and extending into the holding assembly, and a spiral spring mounted inside the holding assembly. The adjusting assembly can be turned for the holding assembly to be unlocked or rotatable such that the spiral spring automatically drives the holding assembly to rotate for winding and collecting the pull cords. Users can pull the pull cords to rotate the holding assembly. When the pull cords need to be positioned, the adjusting assembly can be turned to abut against the holding assembly so that the holding assembly is unable to be rotated and the pull cords can be positioned. Accordingly, the automatic cord collector ensures operational convenience, cord safety and accident prevention.

15 Claims, 8 Drawing Sheets

AUTOMATIC CORD COLLECTOR OF A WINDOW BLIND

BACKGROUND OF THE INVENTION

1. Field of the Invention

The present invention relates to an automatic cord collector, and more particularly to an automatic cord collector of a window blind operated in collaboration with the window blind and connected with a pull cord of the window blind.

2. Description of the Related Art

Conventional window blinds are provided with pull cords for users to easily fold or unfold the window blinds. When running around or playing with the pull cords, children or pets are under threat of being strangled or even suffocated by the pull cords.

To safely place the pull cords of a conventional window blind, a hook can be mounted on a wall with the window blind covered thereon. After pulling the pull cords of the window blind to open/close the window blind, the pull cords can be wound around and tied to the hook to shorten a length of the freely hanging pull cords. The pull cords need to be untied and reversely wound for opening/closing of the window blind once again. Such repeated process for winding and tying the pull cords is inconvenient, and sometimes winding and tying the pull cords may even be forgotten, leaving the life-threatening danger still there.

SUMMARY OF THE INVENTION

An objective of the present invention is to provide an automatic cord collector of a window blind ensuring operational convenience, cord safety and accident prevention.

To achieve the foregoing objective, the automatic cord collector has a housing, a holding assembly, an adjusting assembly and a spiral spring.

The housing has a base and a lid.

The base has a chamber, an opening, two positioning wings and multiple cord holes.

The chamber is defined in the base. The opening is formed through a front side of the base to communicate with the chamber. The two positioning wings are parallelly formed on an inner surface of a rear side of the base and extend into the chamber. The cord holes are formed through the base to communicate with the chamber.

The lid covers the opening of the base, and has a tube and a limit pin. The tube is centrally formed on an inner side of the lid and protrudes into the chamber. The limit pin is formed on an outer side of the lid.

The holding assembly is mounted in the chamber of the base, and has a holding seat and a holding flange.

The holding seat has a spring-holding wall, a stop wall and a positioning chamber.

The spring-holding wall is formed on one side of the holding seat facing the lid and has a mounting space and a cord-receiving space.

The mounting space is defined in the spring-holding wall. The cord-receiving space is defined between the spring-holding wall and the holding seat.

The stop wall is formed on one side of the holding seat facing the base.

The positioning chamber is defined between the stop wall and the base.

The holding flange is mounted around a free end of the spring-holding wall and is adjacent to the lid.

The adjusting assembly is mounted in the housing, extends into the holding assembly, and has a first locating member and a second locating member, an adjusting knob and a clamping piece.

The first locating member and the second locating member are arc-shaped, are mounted in the positioning chamber with two open sides of the first locating member and the second locating member facing each other, and are located between the two positioning wings. Each of the first locating member and the second locating member has an abrasive portion formed on an outer periphery of one of the first locating member and the second locating member and faces the stop wall.

The adjusting knob is mounted through the lid and has a head, a rod, a limiting channel and a clamping piece.

The head is mounted on an outer side of the lid.

The rod is formed on and protrudes inwards from an inner side of the head, is sequentially mounted through the tube of the lid and the holding assembly, extends into the positioning chamber, and has an oval block formed on a free end of the rod, is located between the first locating member and the second locating member, and is selectively driven to abut against the first locating member and the second locating member for the abrasive portions of the first locating member and the second locating member to abut against the stop wall and to position the holding assembly.

The limiting channel is arc-shaped and is formed in the inner side of the head for the limit pin of the lid to be slidably mounted therein.

The clamping piece is mounted on the free end of the rod and faces the first locating member and the second locating member.

The spiral spring is mounted inside the mounting space of the holding assembly with two ends of the spiral spring securely connected with the tube of the lid and the spring-holding wall of the holding assembly.

From the foregoing, the automatic cord collector can control the pull cords for opening or closing a window blind. One end of each pull cord is tied on a periphery of the spring-holding wall for the pull cord to be wound around the spring-holding wall and received in the cord-receiving space, and the other end of the pull cord extends beyond a corresponding cord hole on the base. Users can turn the adjusting assembly to unlock the holding assembly for the holding assembly to be freely rotatable, and the spiral spring then drives the holding assembly to rotate for winding and collecting the pull cords. The pull cords can be positioned by pulling out the pull cords and turning the adjusting knob and the oval block in an opposite direction for the abrasive portions of the first locating member and the second locating member to push against the stop wall of the holding assembly and position the holding assembly once a length of the pull cords is adjusted. Accordingly, the automatic cord collector ensures cord safety, accident prevention and operational convenience upon positioning, winding and collecting the pull cords.

Other objectives, advantages and novel features of the invention will become more apparent from the following detailed description when taken in conjunction with the accompanying drawings.

DETAILED DESCRIPTION OF THE INVENTION

Figure 1:
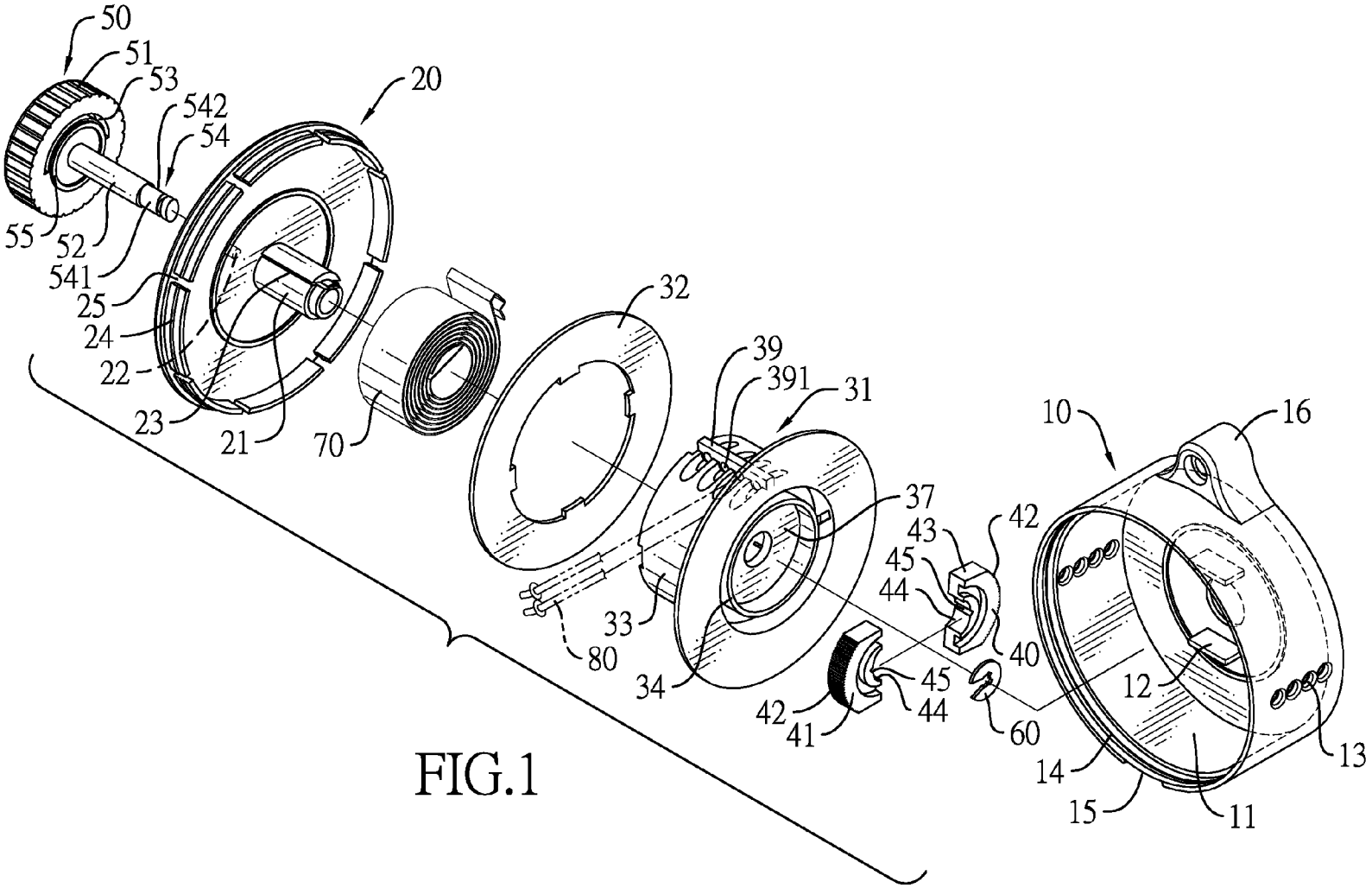
FIG. 1 is an exploded perspective view of an automatic cord collector of a window blind in accordance with the present invention.
Figure 2:
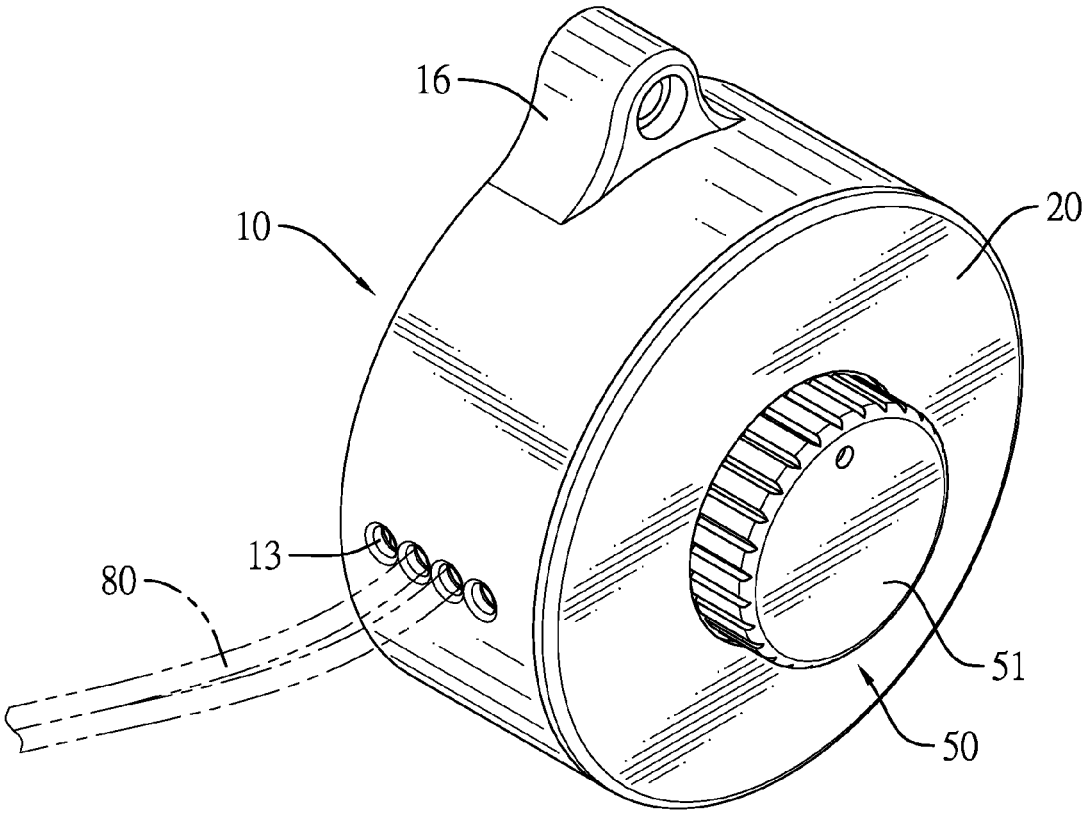
FIG. 2 is a perspective view of the automatic cord collector in FIG. 1.
Figure 3:
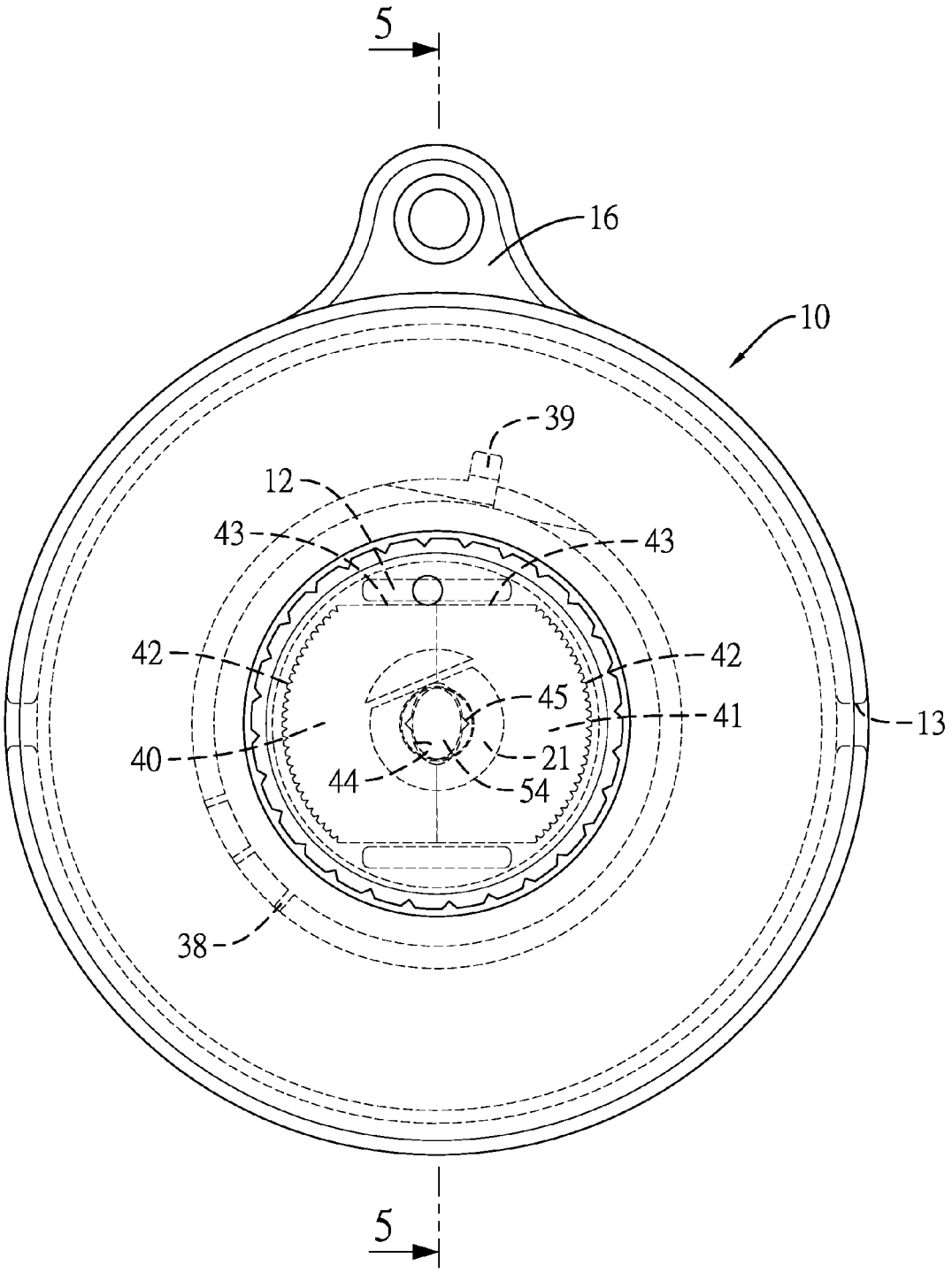
FIG. 3 is a front view of the automatic cord collector in FIG. 1 without a spiral spring mounted therein.
Figure 5:
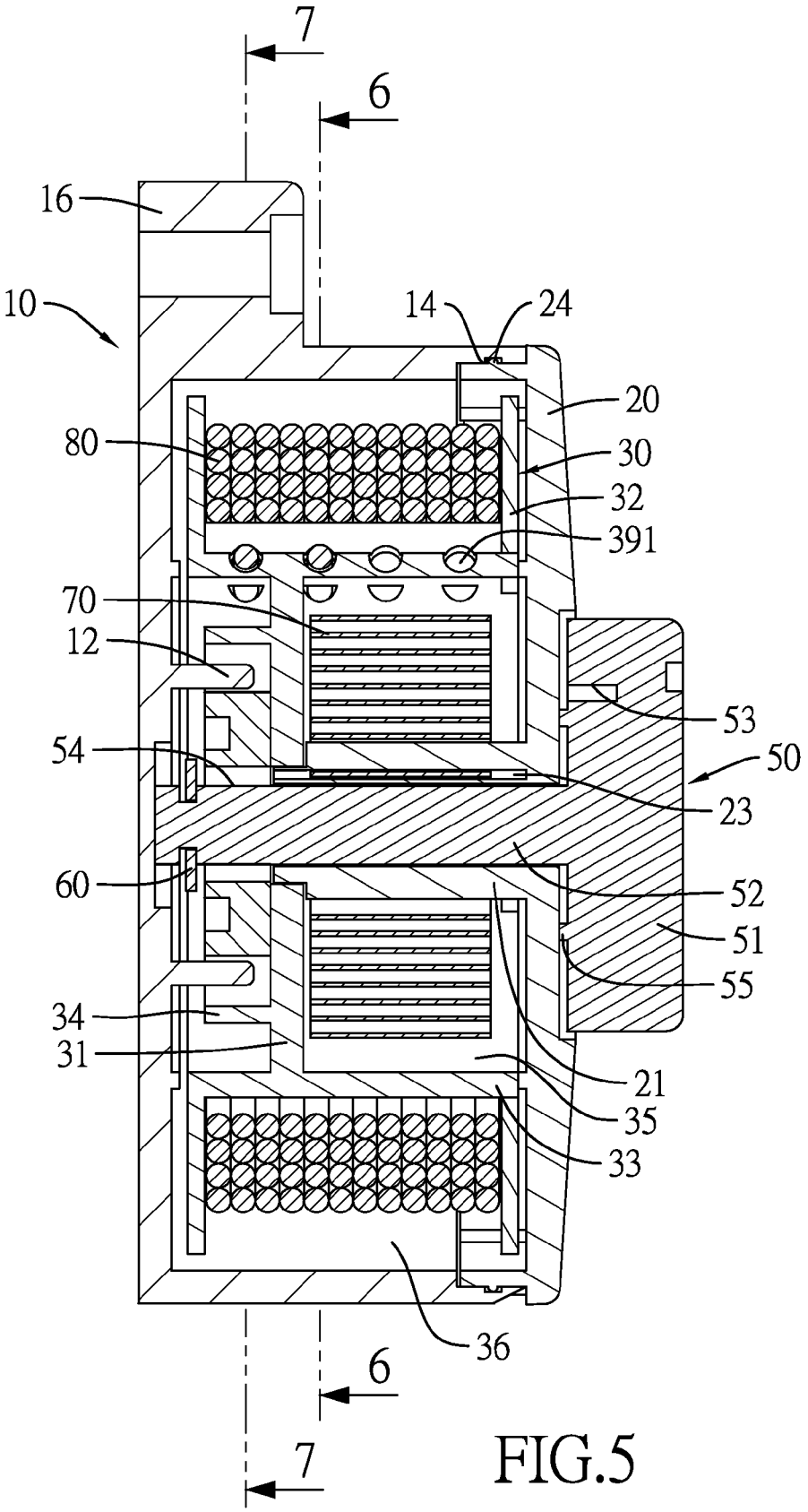
FIG. 5 is a cross-sectional side view of the automatic cord collector along a line 5-5 in FIG. 3.

With reference to FIGS. 1, 3 and 5, an automatic cord collector in accordance with the present invention has a housing, a holding assembly 30, an adjusting assembly and a spiral spring 70.

The housing is cylindrical, and has a base 10 and a lid 20. The base 10 has a chamber 11, an opening, an outer wall, an inner wall, two positioning wings 12, multiple cord holes 13, an annular groove 14, a recess 15 and a mounting ear 16. The chamber 11 is defined in the base 10. The opening is formed through a front side of the base 10 to communicate with the chamber 11. The positioning wings 12 are parallelly formed on an inner surface of the rear side of the base 10 and extend into the chamber 11. The cord holes 13 are in pairs and each pair of cord holes is oppositely formed through the outer wall of the base 10 to communicate with the chamber 11. The annular groove 14 is formed in an edge portion of an inner wall of the base 10 adjacent to the opening. The recess 15 is formed in the inner wall of the base 10 and is adjacent to the lid 20. The mounting ear 16 is formed on the outer wall of the base 10 and has a hole formed through the mounting ear 16. The lid 20 covers the opening of the base 10, and has a tube 21, a limit pin 22, an annular insert 24, and multiple expansion gaps 25. The tube 21 is centrally formed on an inner side of the lid 20 and protrudes into the chamber 11, and has a first positioning slot 23 axially formed in a periphery of the tube 21. The limit pin 22 is formed on an outer side of the lid 20. The annular insert 24 is annularly formed on an edge portion of the inner side of the lid 20 and engages the annular groove 14 of the base 10. The expansion gaps 25 are formed through the annular insert 24 along a circumferential direction and are separated from each other.

With reference to FIGS. 1 and 5, the holding assembly 30 is mounted in the chamber 11 of the base 10, and has a holding seat 31 and a holding flange 32. The holding seat 31 has a spring-holding wall 33, a stop wall 34, a mounting space 35, a cord-receiving space 36 and a positioning chamber 37. The spring-holding wall 33 is formed on one side of the holding seat 31 facing the lid 20 and has a cord-separating block 39 and multiple through holes 391. The cord-separating block 39 is mounted on the periphery of the spring-holding wall 33. The through holes 391 are formed through the cord-separating block 39 and are spaced apart from each other. The stop wall 34 is formed on one side of the holding seat 31 facing the base 10. The mounting space 35 is defined in the spring-holding wall 33. The cord-receiving space 36 is defined between the spring-holding wall 33 and the holding seat 31. The positioning chamber 37 is defined between the stop wall 34 and the base 10. The holding flange 32 is mounted around a free end of the spring-holding wall 33 and is adjacent to the lid 20.

The adjusting assembly is mounted in the housing, extends into the holding assembly 30, and has a first locating member 40, a second locating member 41, an adjusting knob 50 and a clamping piece 60. The first locating member 40 and the second locating member 41 are arc-shaped, are mounted in the positioning chamber 37 with two open sides of the first locating member 40 and the second locating member 41 facing each other, and are located between the two positioning wings 12. Each of the first locating member 41 and the second locating member 41 has an abrasive portion 42, two limiting surfaces 43, and a positioning surface 44. The abrasive portion 42 is formed on an outer periphery of one of the first locating member 40 and the second locating member 41 and faces the stop wall 34. Each limiting surface 43 is blocked by one of the positioning wings 12 of the base 10, and the abrasive portion 42 is connected between the two limiting surfaces 43. The positioning surface 44 is formed on an inner wall of one of the first locating member 40 and the second locating member 41, faces the oval block 54, and has an anti-slip slot 45 formed therein.

Figure 7:
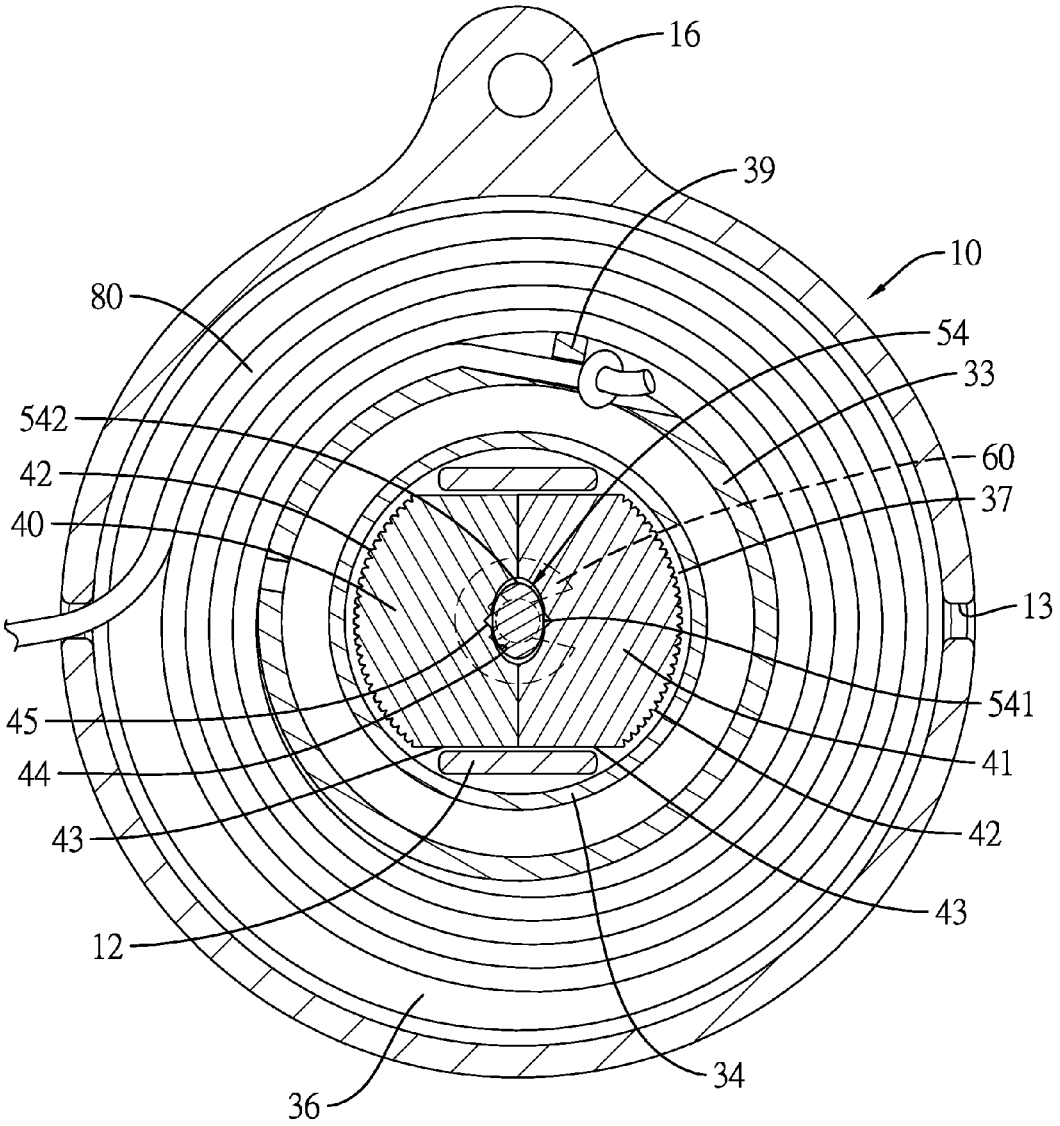
FIG. 7 is an operational cross-sectional front view of the automatic cord collector along a line 7-7 in FIG. 5.

With reference to FIG. 5, the adjusting knob 50 is mounted through the lid 20, and has a head 51, a rod 52, and a limiting channel 53. The head 51 is mounted on the outer side of the lid 20, and has an annular boss 55 formed on an inner side of the head 51 and engaging the outer side of the lid 20. The rod 52 is formed on and protrudes inwards from an inner side of the head 51, is sequentially mounted through the tube 21 of the lid 20 and the holding assembly 30, extends into the positioning chamber 37, and has an oval block 54. The oval block 54 is formed on a free end of the rod 52, is located between the first locating member 40 and the second locating member 41, and is selectively driven to abut against the first locating member 40 and the second locating member 41 so that the abrasive portions 42 of the first locating member 40 and the second locating member 41 can selectively abut against the stop wall 34 to position the holding assembly 30. With reference to FIG. 7, the oval block 54 has a long axis and a short axis, two first arced portions 541 and two second arced portions 542. The first arced portions 541 are formed on two opposite portions on a periphery of the oval block 54, which are adjacent to two endpoints of the short axis. The second arced portions 542 are formed on another two opposite portions on the periphery of the oval block 54, which are adjacent to two endpoints of the long axis. The curvature of the second arced portions 542 is greater than that of the first arced portions 541. The limiting channel 53 is arc-shaped and is formed in the inner side of the head 51 for the limit pin 22 of the lid 20 to be slidably mounted therein. The clamping piece 60 is mounted on the free end of the rod 52 and faces the first locating member 40 and the second locating member 41.

Figure 6:
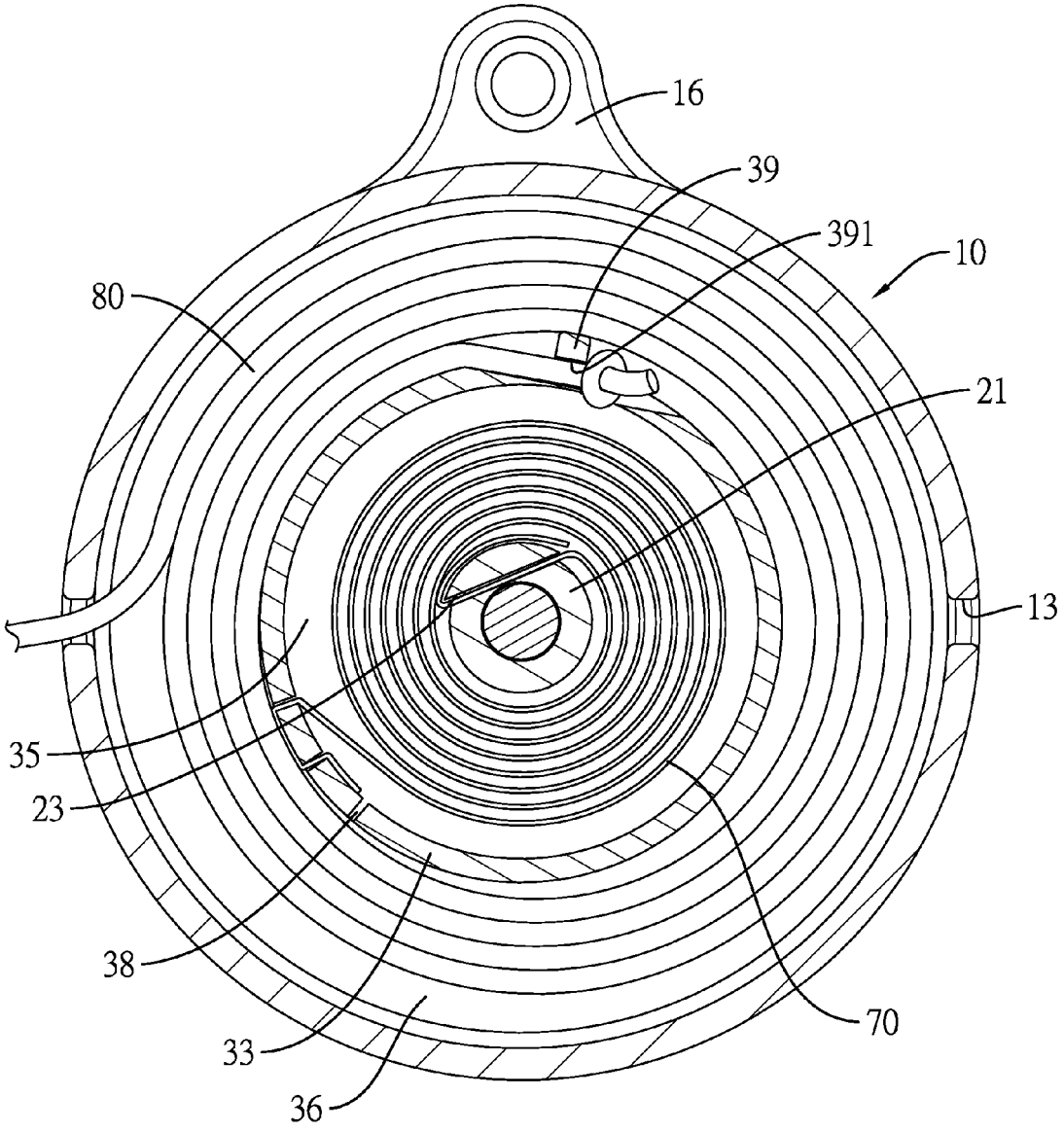
FIG. 6 is a cross-sectional front view of the automatic cord collector along a line 6-6 in FIG. 5.

With reference to FIGS. 5 and 6, the spiral spring 70 is mounted inside the mounting space 35 of the holding assembly 30, and the tube 21 of the lid 20 extends into the mounting space 35 of the holding assembly 30, is mounted through the holding seat 31, and has a first receiving slot 24 formed in an end face of an inner end of the tube 21. The spring-holding wall 33 has at least one second receiving slot 38 formed in an end face of an outer end of the spring-holding wall 33. One of the ends of the spiral spring 70 is inserted into the first receiving slot 24 of the tube 21 and the other end of the spiral spring 70 is inserted into the at least one second receiving slot 38 of the spring-holding wall 33.

Figure 4:
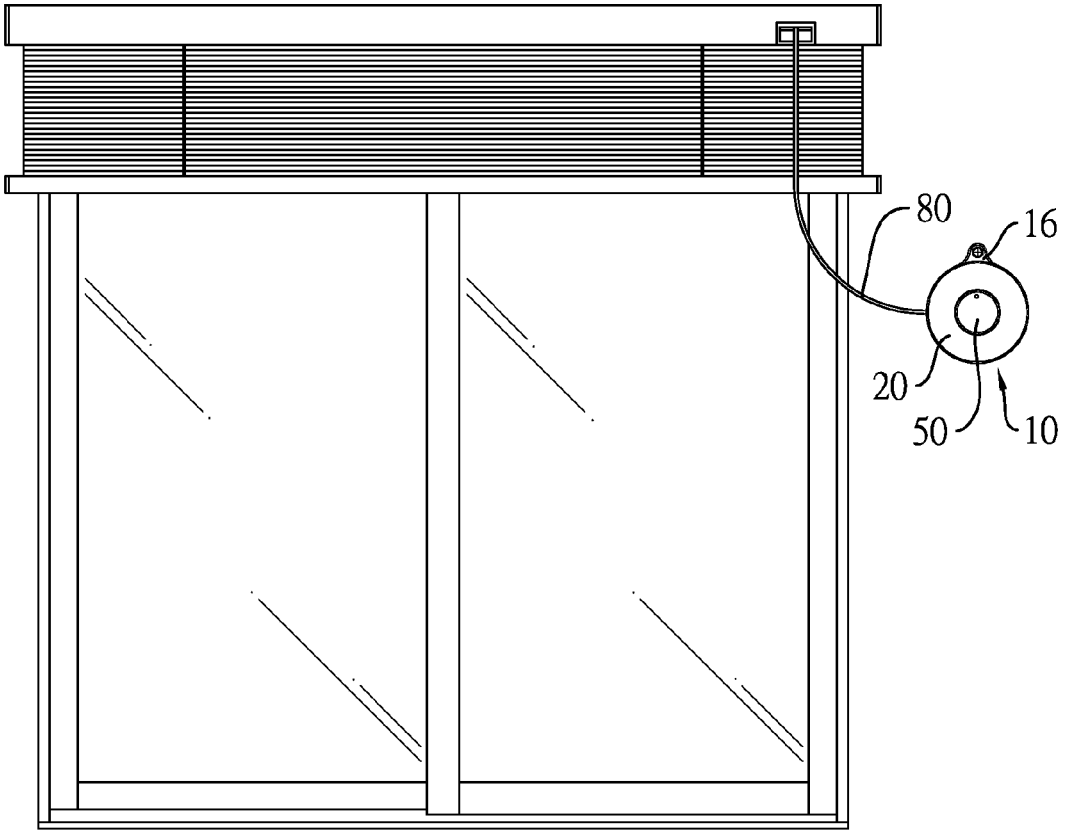
FIG. 4 is an operational front view of the automatic cord collector in FIG. 1.

With reference to FIG. 4, the automatic cord collector can be used to wind and collect multiple pull cords 80 for opening and closing a window blind and can be mounted on a wall adjacent to the blind with a fastener mounted through the mounting ear 16 of the base 10. Alternatively, the base 10 can be attached on a wall with an adhesive material applied to a side of the base 10 opposite to the head 42 of the adjusting knob 50. With further reference to FIGS. 1 and 7, one end of each pull cord 80 is mounted through one of the through holes 391 of the cord-separating block 39 and is tied on the cord-separating block 39 on the spring-holding wall 33. The pull cord 80 is further wound around the spring-holding wall 33 with the other end of the pull cord 80 penetrating through one of the cord holes 13 of the base 10. The through holes 391 are spaced apart from each other so that the multiple pull cords 80 can be simultaneously wound and collected without being entangled.

Figure 8:
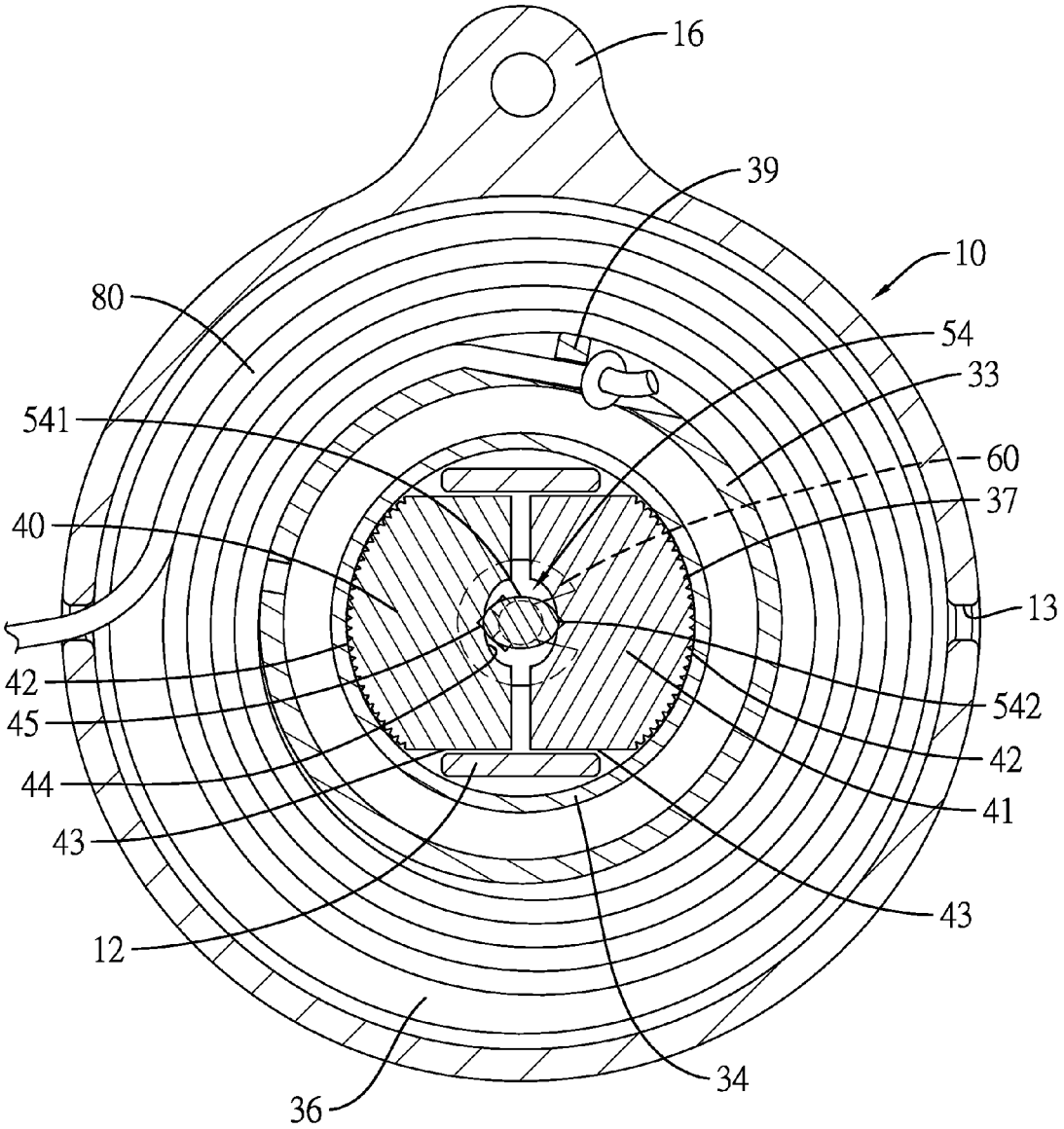
FIG. 8 is an operational cross-sectional view of the automatic cord collector in FIG. 7.

With reference to FIGS. 6 to 8, when intending to adjust a length of the pull cords 80, users can turn the adjusting knob 50 in a direction such that the two first arc portions 541 of the oval block 54 are adjacent to but do not abut against the respective positioning surfaces 44 of the first locating member 40 and the second locating member 41. As the abrasive portions 42 of the first locating member 40 and the second locating member 41 are not pressed upon the stop wall 34 of the holding assembly 30, the holding assembly 30 is rotatable relative to the holding flange 32 due to the restoring force of the spiral spring 70. Accordingly, automatic pull cord collection can be attained. On the other hand, users can pull the pull cords 80 out of the base 10. The holding assembly 30 is rotated by the pull-out of the pull cords. After a length of the pull cords 80 is adjusted, the adjusting knob 50 is turned left or right to position the holding assembly 30. With reference to FIG. 8, after the adjusting knob 50 is turned, the two second arc portions 542 of the oval blocks 54 respectively abut against the positioning surfaces 44 of the first locating member 40 and the second locating member 41 such that the abrasive portions 42 of the first locating member 40 and the second member 41 are pressed upon the stop wall 34 of the holding assembly 30 and the holding assembly 30 is positioned. Accordingly, the holding assembly 30 is locked and the pull cords 80 will not be pulled out of the base 10.

The anti-slip slots 45 on the positioning surfaces 44 of the first locating member 40 and the second locating member 41 are added for the second arc portions 542 of the oval block 54 to be more firmly pressed upon the positioning surfaces 44. The recess 15 on the base 10 allows the lid 20 to be detached from the base 10, and the expansion gaps 25 of the lid 20 allow the lid 20 to be assembled on the base 10. The annular boss 55 formed on the head 51 of the adjusting knob 50 abuts against the lid 20 to reduce a contact area between the head 51 and the lid 20 and to further enhance rotational smoothness between the head 51 and the lid 20. Additionally, the limit pin 22 can be inserted in the limit channel 53 to limit a rotation angle of the adjusting knob 50.

In sum, for automatic cord collection, the adjusting knob 50 is turned to unlock the holding assembly 30 by turning the oval block 54 in a position not abutting against the first locating member 40 and the second locating member 41, such that the spiral spring 70 drives the holding assembly 30 to turn for automatic cord collection of the pull cords 80. On the other hand, the pull cords 80 can be positioned by pulling out the pull cords 80 and turning the adjusting knob 50 for the first locating member 40 and the second locating member 41 to be pressed upon the holding assembly 30 once a length of the pull cords 80 is adjusted. Accordingly, the automatic cord collector increases operational convenience upon winding, collecting and positioning the pull cords 80. Furthermore, children will not get strangled by the pull cords 80 and cord safety and accident prevention can be further ensured.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. An automatic cord collector of a window blind, comprising:

- a housing having:
  - a base having:
    - a chamber defined in the base;
    - an opening formed through a front side of the base to communicate with the chamber;
    - two positioning wings parallelly formed on an inner surface of a rear side of the base and extending into the chamber; and
    - multiple cord holes formed through the base to communicate with the chamber; and
  - a lid covering the opening of the base, and having:
    - a tube centrally formed on an inner side of the lid and protruding into the chamber; and
    - a limit pin formed on an outer side of the lid;
- a holding assembly mounted in the chamber of the base, and having:
  - a holding seat having:
    - a spring-holding wall formed on one side of the holding seat facing the lid and having:
      - a mounting space defined in the spring-holding wall; and
      - a cord-receiving space defined around a periphery of the spring-holding wall;
    - a stop wall formed on one side of the holding seat facing the base; and
    - a positioning chamber defined between the stop wall and the base;
  - a holding flange mounted around a free end of the spring-holding wall and being adjacent to the lid;
- an adjusting assembly mounted in the housing, extending into the holding assembly, and having:
  - a first locating member and a second locating member being arc-shaped, mounted in the positioning chamber with two open sides of the first locating member and the second locating member facing each other, and located between the two positioning wings, each of the first locating member and the second locating member having an abrasive portion formed on an outer periphery of one of the first locating member and the second locating member and facing the stop wall;
  - an adjusting knob mounted through the lid and having:
    - a head mounted on an outer side of the lid;
    - a rod formed on and protruding inwards from an inner side of the head, sequentially mounted through the tube of the lid and the holding assembly, extending into the positioning chamber, and having an oval block formed on a free end of the rod, located between the first locating member and the second locating member, and selectively driven to abut against the first locating member and the second locating member for the abrasive portions of the first locating member and the second locating member to abut against the stop wall and to position the holding assembly;

a limiting channel being arc-shaped and formed in the inner side of the head for the limit pin of the lid to be slidably mounted therein; and a clamping piece mounted on the free end of the rod and facing the first locating member and the second locating member; and a spiral spring mounted inside the mounting space of the holding assembly with two ends of the spiral spring securely connected with the tube of the lid and the spring-holding wall of the holding assembly.

2. The automatic cord collector as claimed in claim 1, wherein each of the first locating member and the second locating member further has:

two limiting surfaces, each limiting surface blocked by one of the positioning wings of the base, wherein the abrasive portion is connected between the two limiting surfaces; and a positioning surface formed on an inner wall of one of the first locating member and the second locating member, facing the oval block, and having an anti-slip slot formed therein.

3. The automatic cord collector as claimed in claim 1, wherein the oval block has:

a short axis;

a long axis;

two first arc portions formed on two opposite portions on a periphery of the oval block in a direction of the short axis; and two second arc portions formed on two opposite portions on a periphery of the oval block in a direction of the long axis, each second arc portion having a curvature greater than the curvature of each first arc portion.

4. The automatic cord collector as claimed in claim 1, wherein the oval block has:

a short axis;

a long axis;

two first arc portions formed on two opposite portions on a periphery of the oval block in a direction of the short axis; and two second arc portions formed on two opposite portions on a periphery of the oval block in a direction of the long axis, each second arc portion having a curvature greater than the curvature of each first arc portion.

5. The automatic cord collector as claimed in claim 1, wherein the tube of the lid extends into the mounting space of the holding assembly, is mounted through the holding seat, and has a first receiving slot formed in an end face of an inner end of the tube;

the spring-holding wall has at least one second receiving slot formed in an end face of an outer end of the spring-holding wall; and one of the ends of the spiral spring is inserted into the first receiving slot of the tube and the other end of the spiral spring is inserted into the at least one second receiving slot of the spring-holding wall.

6. The automatic cord collector as claimed in claim 5, wherein the head of the adjusting knob has an annular boss formed on an inner side of the head and engaging the outer side of the lid.

7. The automatic cord collector as claimed in claim 6, wherein the spring-holding wall of the holding assembly has a cord-separating block mounted on the periphery of the spring-holding wall and having multiple through holes formed through the cord-separating block and spaced apart from each other.

8. The automatic cord collector as claimed in claim 7, wherein the base further has an annular groove formed in an edge portion of an inner wall of the base adjacent to the opening of the base; and the lid has annular insert annularly formed on an edge portion of the inner side of the lid, engaging the annular groove of the base and having multiple expansion gaps formed through the annular insert along a circumferential direction and separated from each other.

9. The automatic cord collector as claimed in claim 8, wherein the base further has a recess formed in the inner wall of the base and being adjacent to the lid.

10. The automatic cord collector as claimed in claim 9, wherein the base further has a mounting ear formed on a periphery of the base.

11. The automatic cord collector as claimed in claim 1, wherein the head of the adjusting knob has an annular boss formed on an inner side of the head and engaging the outer side of the lid.

12. The automatic cord collector as claimed in claim 1, wherein the spring-holding wall of the holding assembly has a cord-separating block mounted on the periphery of the spring-holding wall and having multiple through holes formed through the cord-separating block and spaced apart from each other.

13. The automatic cord collector as claimed in claim 1, wherein the base further has an annular groove formed in an edge portion of an inner wall of the base adjacent to the opening of the base; and the lid has annular insert annularly formed on an edge portion of the inner side of the lid, engaging the annular groove of the base and having multiple expansion gaps formed through the annular insert along a circumferential direction and separated from each other.

14. The automatic cord collector as claimed in claim 1, wherein the base further has a recess formed in the inner wall of the base and being adjacent to the lid.

15. The automatic cord collector as claimed in claim 1, wherein the base further has a mounting ear formed on a periphery of the base.

* * * * *